US006170662B1

(12) United States Patent
Howes

(10) Patent No.: US 6,170,662 B1
(45) Date of Patent: Jan. 9, 2001

(54) PRIZE DELIVERY SYSTEM WITH ASSOCIATED PACKAGE

(76) Inventor: James P. Howes, 122 St. Johns Rd., Wilton, CT (US) 06897

( * ) Notice: Under 35 U.S.C. 154(b), the term of this patent shall be extended for 0 days.

(21) Appl. No.: 09/359,107

(22) Filed: Jul. 22, 1999

Related U.S. Application Data

(60) Provisional application No. 60/094,771, filed on Jul. 31, 1998.

(51) Int. Cl.[7] ..... B65D 85/00; B65D 21/02

(52) U.S. Cl. ..... 206/459.1; 206/232; 206/427; 206/457; 220/23.4; 220/23.86

(58) Field of Search ..... 206/217, 427, 206/457, 459.1, 305, 590, 232; 220/23.4, 23.83, 23.86

(56) References Cited

U.S. PATENT DOCUMENTS 3,063,549 * 11/1962 Weichselbaum ..... 206/523 X
3,848,735 * 11/1974 McGee et al. ..... 206/523 X
4,316,538 2/1982 Manizza .
4,332,325 6/1982 Manizza .
4,453,664 6/1984 Oliff .
4,511,033 * 4/1985 May ..... 206/459.5 X
5,439,103 * 8/1995 Howes ..... 206/217
5,464,092 * 11/1995 Seeley ..... 206/217
5,992,629 * 11/1999 Gullord et al. ..... 206/459.1

* cited by examiner

*Primary Examiner*—Bryon P. Gehman
(74) *Attorney, Agent, or Firm*—Melvin I. Stoltz

(57) ABSTRACT

By providing a prize awarding system which is secretly incorporated into a multi-packed product or assembly, a unique prize delivery system is realized. In the preferred embodiment of the present invention, the prize award system incorporates a separate, independent housing constructed for being inserted into the void zone or open area which exists between the adjacent product holding containers forming a multi-pack assembly. Although the present invention is employable with any multi-pack product or assembly, products retained in cans, bottles, or similar vessels typically benefit most extensively from the present invention. In the present invention, the prize awarding system incorporates the actual prize or incorporates means for informing lucky consumers that a prize has been won, either in an audible or visual message delivery system, on certificates, vouchers, or similar printed materials, or in an electronic chip assembly. The realization that a prize has been won may be attained when the prize is viewed, the printed material is read, or the assembly is opened and an audible and/or visual message is delivered. In an alternate construction, an electronic circuit is enclosed for prize-related activation in association with an over-the-air signal, through radio, television, cable and/or satellite transmission.

16 Claims, 9 Drawing Sheets

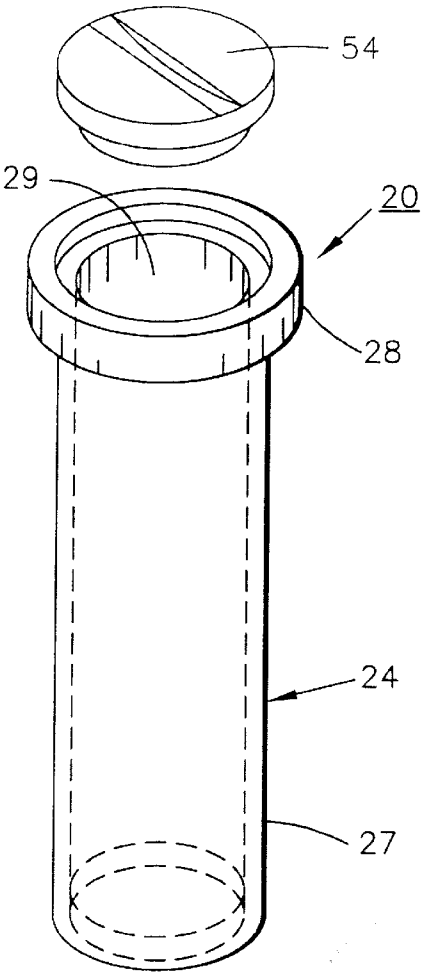
FIG. 11
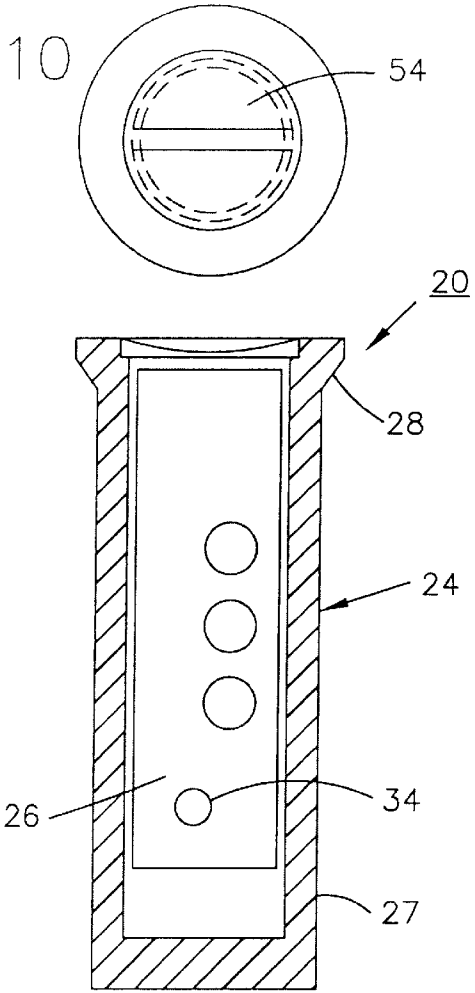
FIG. 10
FIG. 9
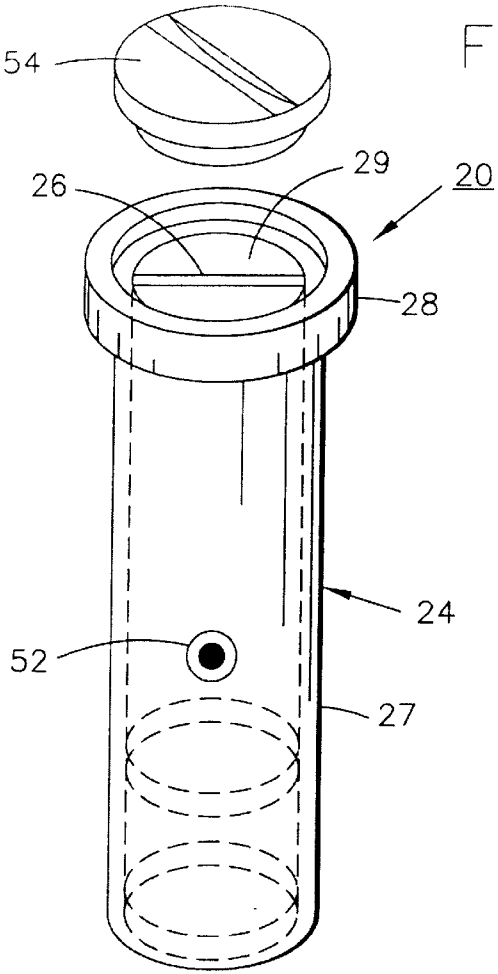
FIG. 8

PRIZE DELIVERY SYSTEM WITH ASSOCIATED PACKAGE

This application is related to Provisional Patent Application Serial No. 60/094,771, filed Jul. 31, 1998 entitled Prize Award System.

TECHNICAL FIELD

This invention relates to prize awarding systems and, more particularly, to prize awarding systems employable with multi-pack products or assemblies.

BACKGROUND ART

Various promotional enhancements have been widely used by companies in order to increase the sale of the companies' products. These promotions are employed by both manufacturers and distributors for a wide variety of diverse products. Although these promotional enhancements take many forms, ranging from price reductions, prizes, games, contests, etc., the sole purpose for all of these promotions is to increase the sale of the underlying product.

One of the promotional methods often employed by manufacturers is the inclusion of a prize in either every product container or in selected containers. In order to attain greater market share for product sales, manufacturers and distributors have utilized a variety of different promotional themes, seeking to generate added sales for their particular products. In doing so, the premium or prize-like promotion has progressed from inexpensive give-aways packed in every product bearing container or package to expensive prize awards which are packed in selected containers or packages. If possible, prize bearing containers are randomly distributed with non-prize bearing containers.

Although these various promotional vehicles have become very popular with some types of products, the ability of certain types of products to be able to use a prize award directly associated with the product has been extremely limited. In this regard, only prize awards which can be separately packaged in acceptable containers or packages and then inserted with the product being distributed have been capable of being commercially feasible. As a result, many products have been incapable of enjoying the benefits derived from promotional vehicles commonly employed with other types of product. Due to this inability, manufacturers or distributors of numerous products have been incapable of employing an effective product sales incentive in order to generate increased interest and sales for their respective products.

In particular, one product area which has been incapable of enjoying the benefits derived from a high value prize promotion is found in the distribution and sale of multi-pack products or assemblies, namely products which are sold in a plurality of independent containers, each of which are integrally interconnected with each other to form a single package or assembly. Although attempts have been made to offer prize awards in multi-pack products, the prize awards have typically been low value, inexpensive prizes which are distributed in each multi-pack product/container.

Due to the cost and potential threat of theft, high value prize awards have never been distributed in multi-pack products or containers. Furthermore, no prior art system has been able to provide a high value prize awards system which is capable of being secretly retained in a multi-pack product/assembly. In this way, prize bearing multi-pack products/assemblies can be randomly distributed with non-prize bearing multi-pack products/assemblies, or high value prizes or electronic prize means can be secretly retained in the multi-pack products/assemblies.

Therefore, it is a principal object of the present invention to provide a promotional system which is capable of being employed easily and conveniently in connection with a wide variety of consumer products, such as multi-pack food and beverage products.

Another object of the present invention is to provide a prize awarding system and promotional method having the characteristic features described above which is capable of being implemented in a simple, straightforward manner, without requiring changes in manufacturing processes for the products being promoted.

Another object of the present invention is to provide a prize awarding system and promotion al method having the characteristic features described above which enables virtually any consumer oriented multi-pack product to be easily promoted in a contest which generates a high level of interest and excitement.

Other and more specific objects will in part be obvious and will in part appear hereinafter.

SUMMARY OF THE INVENTION

By employing the present invention, the prior art inabilities and drawbacks are completely overcome and any manufactured, multi-packed product or assembly is capable of enjoying the benefits of increased sales resulting from prize award contests. In accordance with the present invention, the actual multi-pack product or assembly is constructed in the substantially identical manner typically employed, with a prize awarding system of the present invention being secretly incorporated into the multi-pack assembly.

In accordance with the present invention, the prize awarding system incorporates the actual prize, such as cash, jewelry, tickets, and the like, or incorporates means for informing lucky consumers that a prize has been won, either in an audible or visual message delivery system, on certificates, vouchers, or the like, or in an electronic chip assembly. The realization that a prize has been won may be attained when the prize is viewed, the printed material is read, or the assembly is opened and an audible and/or visual message is delivered. In an alternate construction, an electronic circuit is enclosed for prize-related activation in association with an over-the-air signal, such as radio, television, cable and/or satellite transmission which activates the receiving electronic circuit.

Using the present invention, prize bearing multi-pack products/assemblies are able to be sold in direct association with non-prize bearing multi-pack products/assemblies, if desired, without any difficulty and without the consumer being able to discover in advance which multi-pack products/assemblies incorporate prize award systems.

In the preferred embodiment of the present invention, the prize award system incorporates a separate, independent housing constructed for being inserted into the void zone or open area which exists between the adjacent product holding containers forming the multi-pack assembly. Although the present invention is employable with any multi-pack product or assembly, products retained in cans, bottles, or similar vessels typically benefit most extensively from the present invention. In such multi-pack assemblies of cans, bottles, and the like, a well-defined open area exists between the adjacent cans or bottles. It is this open area or void zone which is employed for a secretly retaining the prize award system of the present invention.

In accordance with the present invention, the separate independent housing is constructed with a size and shape enabling the housing to be conveniently inserted and retained in the void zone or open area between adjacent product holding containers. Although the housing may be affixed to one or more containers by adhesive means, in the preferred embodiment, the housing is constructed for cooperating with the normal shape of the product holding containers for enabling the prize-retaining housing to be self-supporting in the open zone, cooperating with the shoulders, edges, or other convenient area of the product holding container.

In addition, a prize designating member or system is mounted in the housing for providing the consumer with the actual prize, with prize-related information, or with means for enabling the consumer to participate in a special award program. In one such embodiment, an audible and/or visual prize related message delivery system is mounted within the independent housing and is constructed for being automatically activated upon removal of the housing from the storage zone between adjacent product holding containers. In this way, a prize award announcement is automatically made, informing the consumer of the actual prize that has been won or, alternatively, the message delivery system can incorporate a musical background or a visual display such as a light or LED to accompany the winning of a prize which may be cash or some other prize item or may be represented by a coupon in the housing. In this way, the thrill and excitement of winning a prize award is enhanced and made substantially more important and significant.

In an alternate embodiment of the present invention, the prize designating system mounted in the housing comprises circuitry for enabling the consumer to participate in a special over-the-air broadcast such as a television program. The circuit is constructed for being activated by a special signal and, when activated, informs the consumer that a prize has been won and/or the identity of the prize.

As discussed above, in the present invention, the housing, which incorporates the prize designating member or system, is constructed for being inserted into the void zone formed between adjacent containers forming the multi-pack. Although such void zones may comprise substantially different sizes and shapes, depending upon the construction of the container, a typical void zone is found in beverage holding cans which have void zones at both the top and bottom of the can. If desired, the housing can be constructed with a size and shape for being secretly retained in one or more of such void zones formed at the top and bottom of the container. In an alternate construction, the housing can be configured for mounted engagement in a void zone formed in the container itself.

If desired, a plurality of prize award systems may be positioned in a multi-pack product/assembly. Depending upon the particular promotion being employed, a plurality of prize award systems can be used and mounted in one or more of the void zones established between adjacent containers or in the void zones of the containers themselves. In this way, sales of larger multi-pack product/assemblies such as twelve container packs, eighteen container packs or twenty-four container packs can be promoted by incorporating three or more prize award systems in such multi-packs, as opposed to a single prize award system in a six container product.

By employing the present invention, if desired, prize bearing, multi-pack products/assemblies can be randomly distributed with non-prize bearing multi-pack products/assemblies with assurance that discovery of the prize-bearing multi-pack products/assemblies are incapable of being discovered prior to opening of the multi-pack product/assembly. As a result, only lucky consumers who unknowingly select a prize bearing multi-pack product/assembly are surprised upon opening the product/assembly and observing the presence of a prize awarding system. Furthermore, by incorporating the embodiment of the present invention which employs the inclusion of an actual prize or a prize-related visual or audible message as the means for announcing the prize award or the means for accompanying the actual prize award as a further enhancement to the moment, consumers are further excited by the realization that a prize award has been won.

In addition to providing a unique prize award system which is capable of being positioned in association with a plurality of separate containers in a unique manner, the prize award system of the present invention enables manufactures and distributors of multi-pack products/assemblies to employ this unique incentive promotion. In addition, the present invention is employable with any multi-pack product/assembly, regardless of the product retained in the independent cans, bottles, or product holding vessels. Although most typically employed with containers for beverage and other food products, numerous other products such as liquid detergents, soaps, bleaches, washing compositions, automotive oils, lubricants and the like sold in multi-pack packages/assemblies can employ and benefit from the teaching of the present invention.

The invention accordingly comprises the features of construction, combinations of elements and arrangement of parts which will be exemplified in the constructions hereinafter described, and the scope of the invention will be indicated in the claims.

DESCRIPTION OF THE DRAWINGS

For a fuller understanding of the nature and objects of the invention, reference should be had to the following detailed description, taken in connection with the accompanying drawings, in which:

FIG. 8 is an exploded perspective view of a further alternate embodiment of a prize award system manufactured in accordance with the present invention;

FIG. 9 is a cross-sectional side elevation view of the prize award system depicted in FIG. 8;

FIG. 10 is a top plan view of the prize award system of FIG. 8;

FIG. 11 is an exploded perspective view of a still further alternate embodiment of the prize award system of the present invention;

DETAILED DISCLOSURE

By referring to FIGS. 1–16, along with the following detailed disclosure, the overall construction and operation of the prize award system of the present invention can best be understood. In the following disclosure, a plurality of alternate embodiments of the prize award system of the present invention are disclosed. However, as is apparent from this disclosure, further alternate constructions can be employed without departing from the scope of the present invention. Consequently, it is to be understood that the following disclosure and the specifically detailed alternate embodiments are provided for exemplary purposes, and are not intended as a limitation of the present invention.

Figure 1:
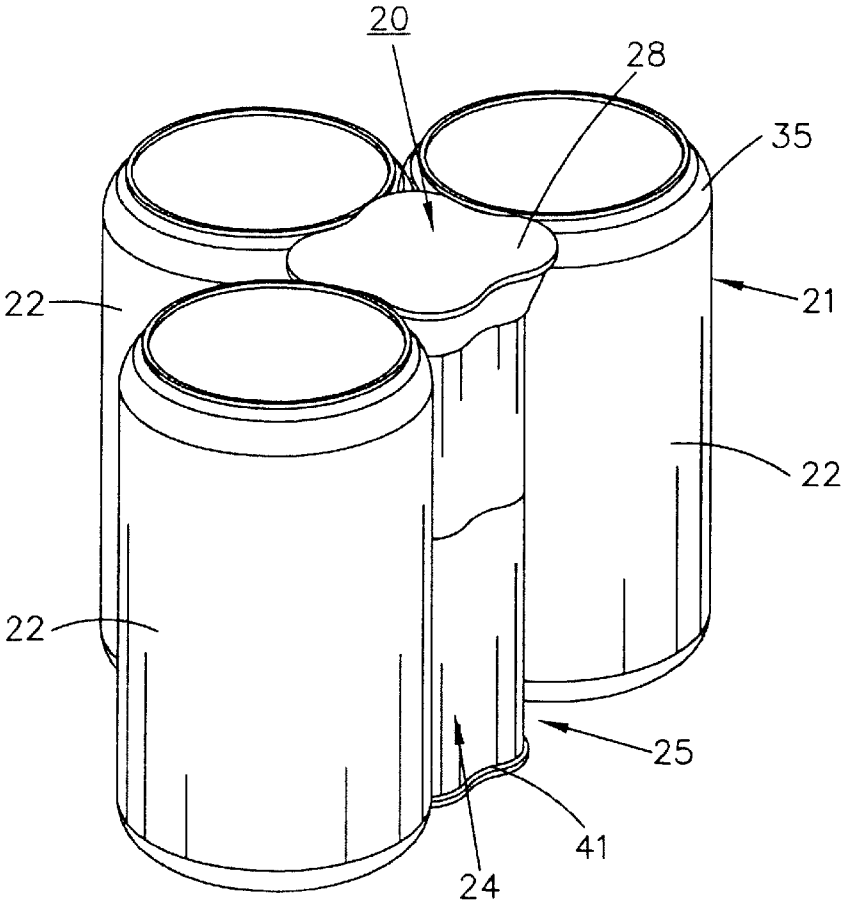
FIG. 1 is a perspective view depicting one embodiment of the prize award system of the present invention in association with a plurality of containers forming a multi-pack product/assembly.
Figure 2:
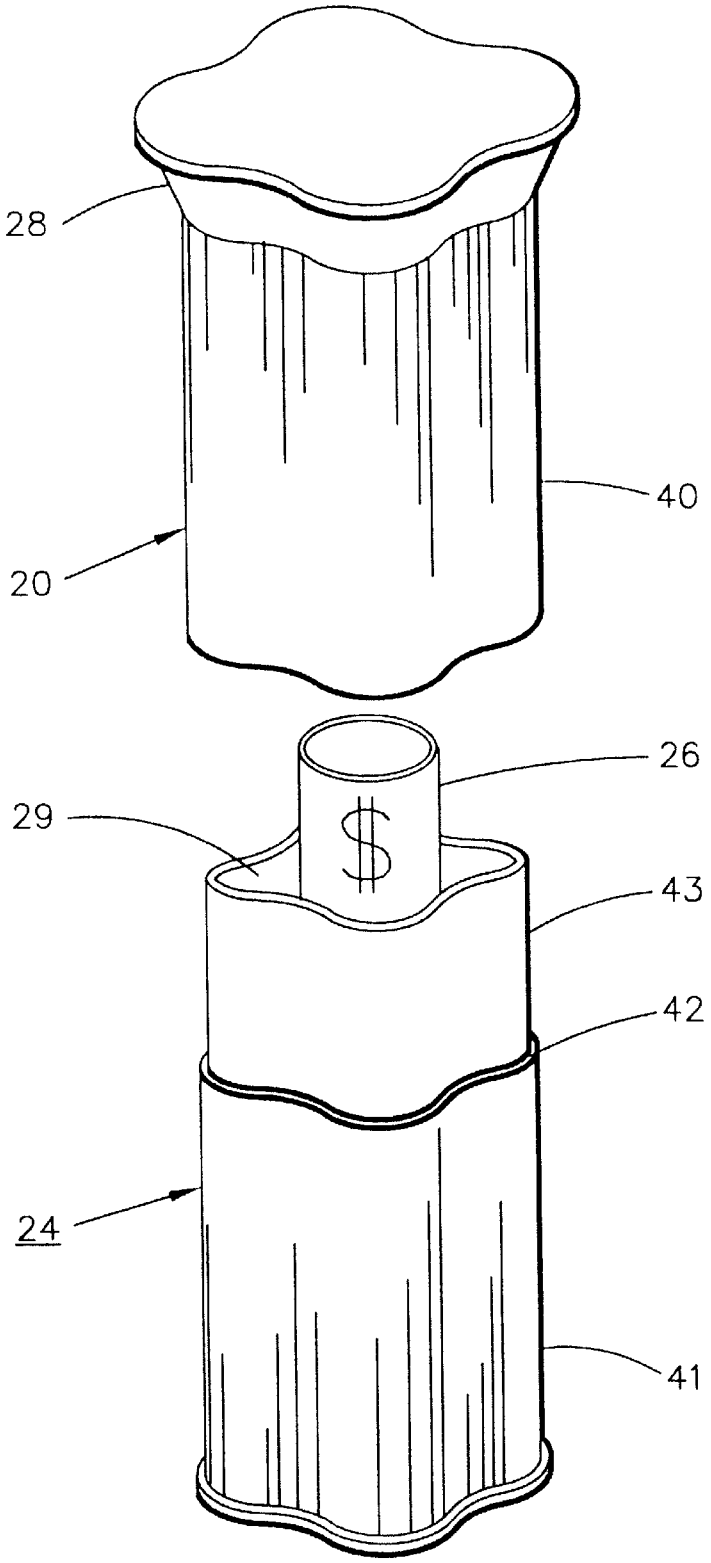
FIG. 2 is an exploded perspective view of the prize award system of FIG. 1.

In FIGS. 1 and 2, one preferred embodiment of prize award system 20 is depicted in association with multi-pack product or assembly 21, which comprises a plurality of containers 22, shown in the form of soda cans. However, as discussed above, soda cans are shown for exemplary purposes only, and containers 22 may comprise any size, shape, and/or material which is desired for retaining the product being sold.

As depicted, containers 22 incorporate a shoulder 35 which is formed between the top of container 22 and the outer side wall thereof. As detailed herein, shoulder 35 is employed, in the preferred embodiment of the present invention, for supportingly retaining prize award system 20 in the desired position.

In this preferred embodiment, prize award system 20 comprises housing 24 which is constructed with a size and shape for being inserted and securely retained within void zone or open area 25. As depicted, void zone 25 is formed between adjacent cans 22, when cans 22 are in their normal cooperatively engaged configuration forming multi-pack product/assembly 21. In addition, in this embodiment, prize designating member or system 26 is employed and is mounted in secure retention within housing 24.

In this embodiment, housing 24 comprises an elongated, longitudinally extending shape, formed in a generally rectangular or square-shaped cross-section. As depicted, in this embodiment, the edges of housing 24 are rounded for conforming to the overall configuration established by void zone 25 formed between adjacent containers 22.

In addition, in this embodiment, housing 24 comprises an upper portion 40 and a lower portion 41 which are constructed for telescopic, mating interengagement with each other. As depicted, lower portion 41 incorporates a ledge 42 formed in the outer surface thereof and a cooperating upstanding wall 43 which extends from ledge 42 to form an inwardly positioned surface for mating interengagement with a cooperating surface of upper portion 40. Furthermore, both upper portion 40 and lower portion 41 incorporate an internal cavity 29 within which prize designating member or system 26 is positioned for secure, undiscoverable retention until housing 24 is opened.

In order to assure that housing 24 is securely retained in the precisely desired position in open area/void zone 25 of multi-pack product/assembly 21, housing 24 preferably incorporates an outwardly extending or diverging collar portion 28 formed in upper portion 40 and constructed for cooperative interengagement with shoulder 35 of containers 22. By employing this construction, housing 24 is quickly and easily inserted into open area/void zone 25 during the assembly of containers 22 into multi-pack product/assembly 21, enabling housing 24 to be securely retained in the desired position without fear of being dislodged or discovered prior to removal of securement means maintaining containers 22 as a fully integrated, multi-pack product/assembly 21.

In the generally conventional construction employed by most manufacturers of multi-pack product/assemblies 21, the plurality of containers 22 forming the multi-pack product/assembly 21 are mounted in juxtaposed, side to side cooperating relationship, and then wrapped on at least four sides with a generally continuous sheet of material. Typically, cardboard is employed, however, numerous other flexible materials are also employed with equal efficacy.

In addition to providing a method for enabling the containers 22 to be easily handled as a single multi-pack product/assembly, the wrapping or securement means is also constructed from material which opaque. Consequently, consumers are unable to see all of the wrapped containers and, as a result, are unable to determine in advance whether prize award system 20 is mounted in any particular multi-pack product/assembly 21. Consequently, prize bearing multi-pack product/assemblies 21 can be randomly intermixed with non-prize bearing multi-pack product/assemblies 21 without fear of having a consumer detect in advance which multi-pack product/assembly 21 incorporates a prize award.

Furthermore, by securing prize award system 20 of the present invention in direct association within void zones/open area 25 of multi-pack product/assembly 21, any movement of prize award system 20 is prevented. Consequently, any attempt by a consumer to determine the presence of prize award system 20 in a multi-pack product/assembly 21 is thwarted, since no visual or manual manipulation of the multi-pack product/assembly 21 is capable of revealing the presence of prize award system 20. Consequently, manufacturers are assured that random distribution of multi-pack product/assembly 21 incorporating a prize award can be effectively achieved in direct association with non-prize bearing multi-pack product/assemblies 21.

In addition, by positioning prize designating member or system 26 in cavity 29 of housing 24, a precisely desired prize award is securely retained in housing 24 with the existence of prize designating member 26 being completely unknown and undiscoverable to the consumer before opening multi-pack product assembly 21. Furthermore, as is more fully detailed below, prize designating member 26 may comprise a wide variety of alternate forms, constructions, or configurations.

As examples of the wide variety of prize designating members/systems that may be positioned in cavity 29 of housing 24, prize designating member or system 26 may comprise a cash award in the form of currency of any desired denomination which is rolled into a compact form for secure retention in cavity 29. Alternatively, printed vouchers, coupons or certificates detailing any desired prize, such as television sets, stereos, trips, etc., may be positioned in cavity 29. Prize designating members or systems of this general nature are fully detailed in U.S. Pat. Nos. 4,911,320; 5,056,659; and 5,056,681.

In addition, prize designating member or system 26 may comprise a visual or audible prize related message delivery system mounted in cavity 29 of housing 24. Preferably, prize designating member or system 26 of this construction would be activated upon the opening of housing 24, providing a prize award announcement informing the consumer of the actual prize that has been won or, alternatively, providing musical background or a visual display to accompany the winning of a prize which is physically mounted within cavity 29 of housing 24. The overall construction and general operation of a prize designating message delivery system of this nature is fully disclosed in U.S. Pat. Nos. 5,099,232; 5,283,567; and 5,439,103.

In an alternate construction which is further detailed below, prize designating member or system 26 may comprise circuitry for awarding a prize to a consumer in cooperation with another product, such as a television or radio, during a particular broadcast when a special prize awarding signal is transmitted. In this way, consumers are able to participate in a specially created broadcast at which time various different prize designating signals are transmitted which will activate specific prize designating members or systems 26 which the consumers would have in their possession from housing 24. In this way, greater excitement, interest and anticipation is created for the award program, as well as the purchase of the product within which prize designating members or systems 26 are secretly retained.

Figure 4:
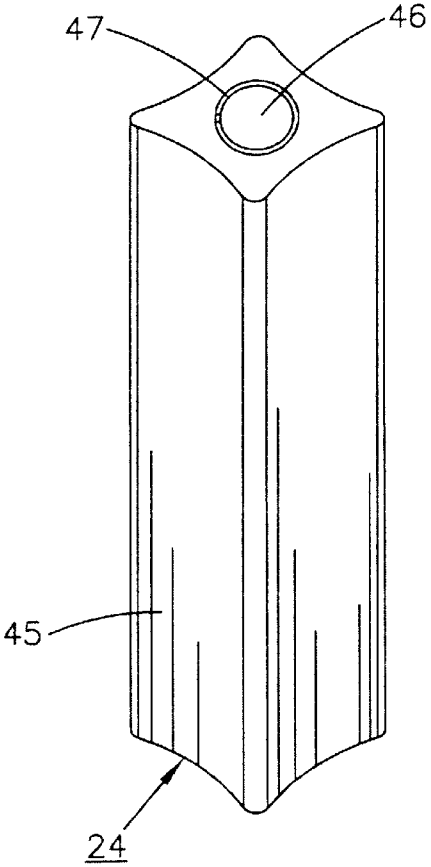
FIG. 4 is a perspective view of a further alternate embodiment of the prize award system of the present invention.
Figure 3:
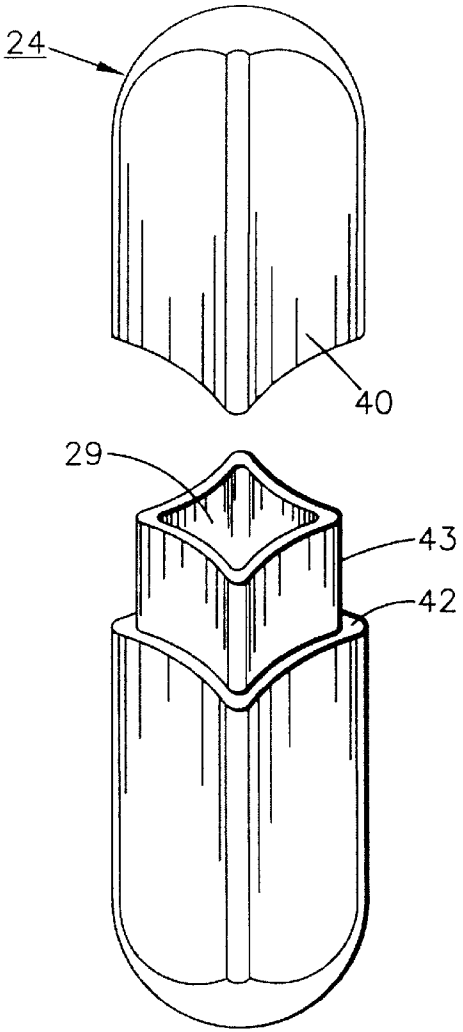
FIG. 3 is an exploded perspective view of an alternate construction for the prize award system of the present invention.

In FIGS. 3 and 4, two alternate constructions for housing 24 of prize award system 20 of the present invention are depicted. In both of these embodiments, housing 24 is constructed in a substantially elongated, generally rectangular or square shape, having concave side walls and rounded edges in order to easily be inserted in void zone/open area 25 of a multi-pack product/assembly 21.

In the construction of the embodiments depicted in FIGS. 3 and 4, housing 24 of each embodiment is constructed for frictionally contacting the side walls of containers 22 which form multi-pack product/assembly 21. As a result, these embodiments do not incorporate an outwardly extending or diverging collar portion 28 for engaging with the shoulders of containers 22.

Although the construction of housing 24 of these embodiments of prize award system 20 are intended to be securely retained in a multi-pack product/assembly 21 by frictional engagement, adhesive means may be employed, if desired, to assure that each housing 24 of these embodiments are incapable of being dislodged from engagement with containers 22 during shipping and handling. In this regard, any desired adhesive means may be employed for securing at least one surface of prize award system 20 to a surface of at least one container 22.

In the embodiment depicted in FIG. 3, a two-piece construction is shown incorporating an upper portion 40 and a lower portion 41, configured in a manner generally similar to the embodiments detailed above and shown in FIGS. 1–2. In this regard, lower portion 41 incorporates a ledge 42 and inwardly positioned, upstanding wall 43 constructed for telescopic locking interengagment with upper portion 40. In addition, housing 24 also incorporates cavity 29 within which the desired prize designating member or system is retained.

As depicted, housing 24 of FIG. 3 comprises a preferred, smoothly rounded, aesthetically pleasing configuration. However, this configuration is merely for exemplary purposes, and any desired alternate configuration or construction can be employed without departing from the present invention.

In the embodiment depicted in FIG. 4, housing 24 possesses a generally elongated, longitudinally extending shape, while comprising a construction strikingly different from the constructions detailed above in reference to FIGS. 1–3. In this embodiment, housing 24 comprises an outer member 45, which forms the principal component of housing 24, while also incorporating an elongated, cylindrically shaped, inner member 46 which is mounted in receiving cavity 47 longitudinally extending through outer member 45. In the preferred construction, inner member 46 is telescopically movable in cavity 47, in order to enable inner member 46 to be inserted into outer member 45, as well as be easily removed therefrom.

In the preferred construction, inner member 46 comprises a receiving cavity in order to enable a prize award member or system to be mounted therewith. In this regard, a wide variety of alternate constructions can be employed, such as incorporating an opening in an otherwise hollow cylindrical shape or forming member 46 with two independent components which are telescopically interengageable with each other, as generally depicted in FIGS. 1–3. Regardless of the configuration employed, inner member 46 enables any desired prize designating member or system to be securely mounted therewith for delivery to the consumer upon removal of inner member 46 from outer member 45.

Figure 5:
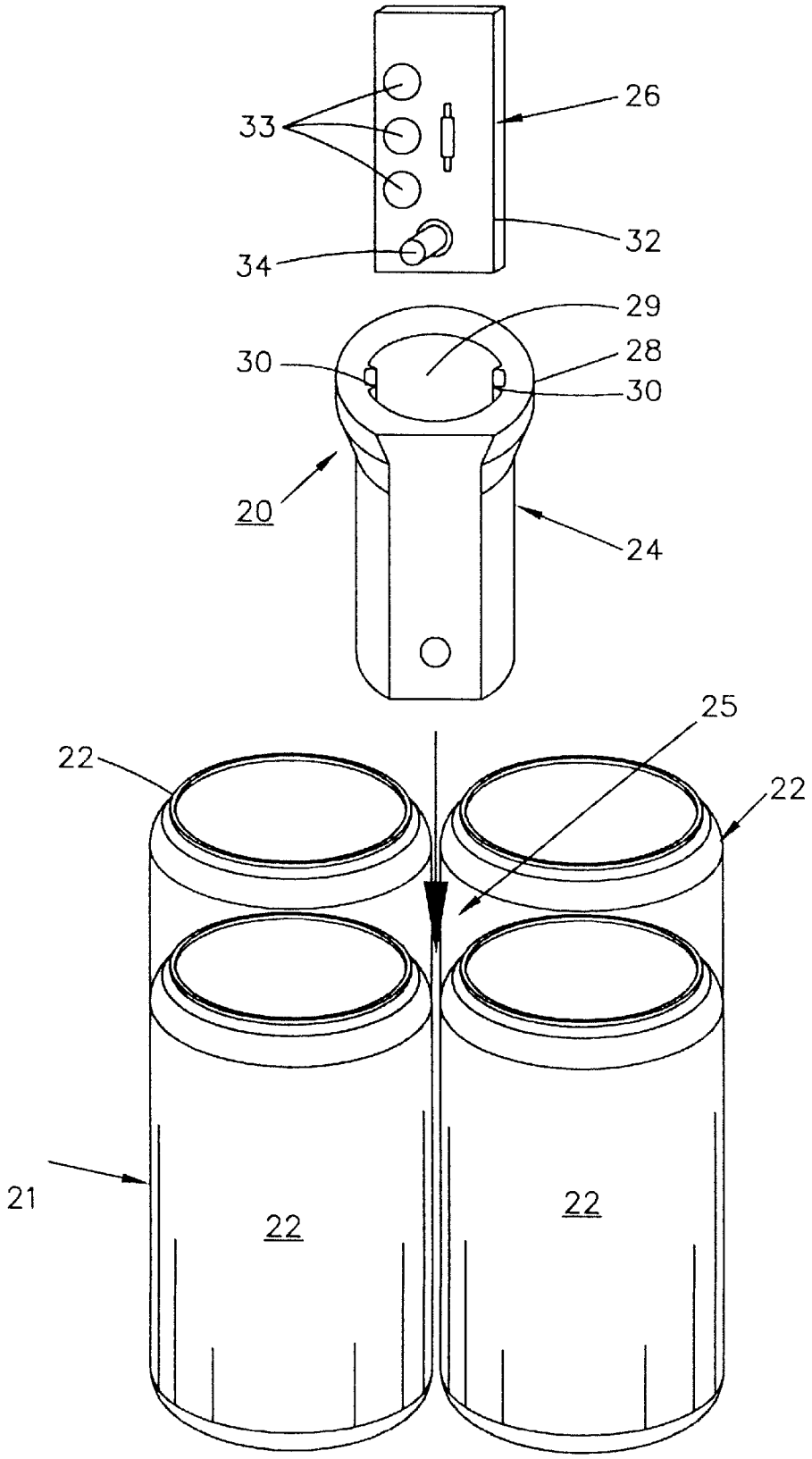
FIG. 5 is an exploded perspective view depicting another embodiment of the prize award system of the present invention in association with a plurality of containers forming a multi-pack product/assembly.
Figure 7:
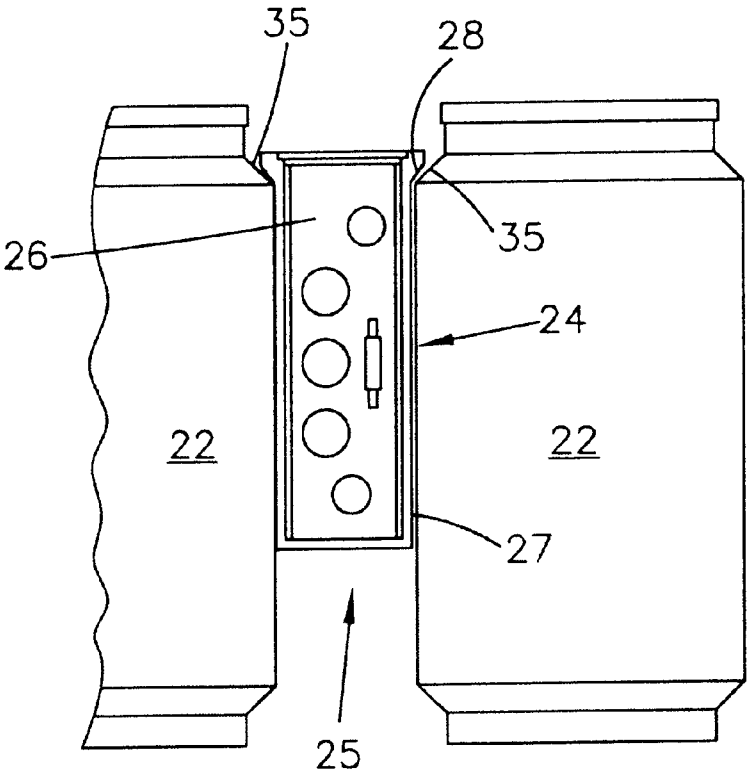
FIG. 7 is a side elevation view, partially in cross-section, depicting the prize award delivery system of FIG. 6 positioned in direct association in the void zone formed between two adjacent product holding cans.
Figure 6:
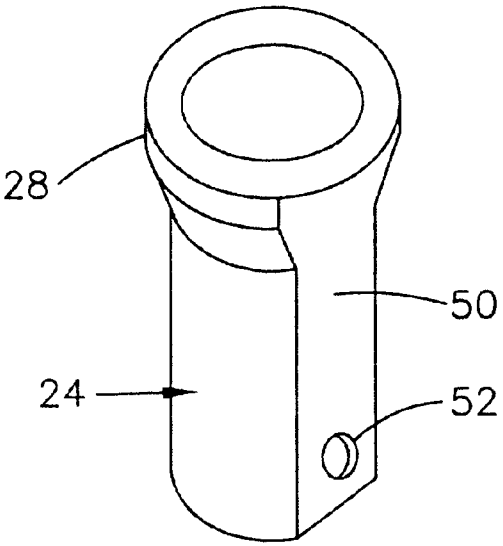
FIG. 6 is a perspective view of the prize award system depicted in FIG. 5.

In FIGS. 5–7, another preferred embodiment of prize award system 20 of the present invention is depicted in association with multi-pack product/assembly 21, which comprises a plurality of containers 22. As with the embodiments detailed above, prize award system 20 of FIGS. 5–7 comprises a housing 24 which is constructed with a size and shape for being inserted and securely retained in void zones/open areas 25.

In this embodiment, housing 24 comprises an elongated, longitudinally extending shape, formed as a generally cylindrical hollow member which terminates at one end with an outwardly extending, diverging collar portion 28. In addition, housing 24 incorporates an internal cavity 29 within which prize designating member/system 26 is positioned for secure retention. In the preferred construction, housing 24 also incorporates retention means 30 formed in cavity 29, preferably in the form of guiding slots, for enabling prize designating member/system 26 to be easily inserted into cavity 29 and securely retained therein.

In the embodiment depicted in FIGS. 5–7, prize designating member/system 26 comprises an integrated circuit formed in or mounted to printed circuit board 32. In the preferred embodiment, printed circuit board 32 also incorporates a self-contained power source 33, preferably in the form of batteries, and circuit activation means 34, depicted as a light sensor. Depending upon the type of promotion desired, prize designating member/system 26 may comprise any desired audible or visual display system for awarding a prize to a consumer or for cooperating with another home product, such as a radio or television, for designating the prize award.

As discussed above, in one embodiment of the present invention, prize designating member/system 26 comprises a prize related, message delivery system which produces an audible or visual message upon activation, informing the consumer that a prize has been won, or providing an audible or visual background for enhancing the excitement upon winning a prize award. Alternatively, if desired, prize designating member/system 26 comprises a printed circuit board construction for use in conjunction with a pre-designated, over-the-air broadcast, such as a radio or television program. In this embodiment, radio or television signals are transmitted and certain pre-selected circuit boards are activated, to inform the consumers that a prize has been won and/or the particular prize award. Either of these two embodiments are highly effective for providing the desired results. In addition, other prize designating or prize related constructions can be employed without departing from the scope of the present invention.

Regardless of which construction is employed for prize designating member/system 26, the desired components are positioned within cavity 29 of housing 24. Once prize award system 20 is fully assembled, prize award system 20 is inserted within void zone 25 of multi-pack product/assembly 21 in secure retained mounted engagement therewith. As best seen in FIG. 7, diverging collar portion 28 of housing 24 is constructed for cooperative contacting interengagement with shoulders 35 of cans 22. As a result, housing 24 is easily suspended in contact with shoulders 35 of cans 22, with housing 24 extending into void zone 25 in secret, retained, mounted interengagement therein. By employing this construction, prize award system 20 of the present invention is easily, supportingly retained in multi-pack product/assembly 21 in direct association with cans 22, without requiring special adhesive means or other retention members.

In FIGS. 5–7, prize award system 20 is depicted with housing 24 configured for securely retaining a prize designating member/system 26 which is constructed for activation when employed in connection with a broadcast program. As a result, the embodiment of housing 24 depicted in these Figures incorporates a substantially flat surface 50 and a portal 52 cooperatively aligned with circuit activation means 34. By employing this construction, surface 50 is easily positioned directly on a television screen or near a radio, with the signals generated by the television/radio being easily recognized by circuit activation means 34. In this way, prize award system 20, having this configuration, receives a special broadcast signal which activates one or more integrated circuits as the prize award circuits by causing the circuit to produce a desired audible message or visual display to inform the consumer that a prize has been won. If a message delivery circuit is desired which is activated without requiring a television or radio signal transmission, the use flat surface 41 may be eliminated as well as portal 42, depending upon the means employed for activating the circuit.

In FIGS. 8–16, further alternate embodiments of prize award system 20 of the present invention are depicted. These alternate embodiment are provided as samples of the numerous alternate configurations and constructions that can be employed for carrying out the present invention. However, these alternate embodiments are intended as further examples of the present invention and are not intended as limiting the present invention to these specific further embodiments.

In the embodiment depicted in FIGS. 8–10, prize award system 20 is shown comprising housing 24 which incorporates an elongated, cylindrical shape and diverging collar portion 28 in conjunction with a removable cap or cover 54. In the embodiment depicted in these Figures, prize designating member/system 26 is retained within cavity 29 of housing 24 in a manner similar to the retention system detailed above. As detailed above, prize designating member/system 26 is mounted in cavity 29 of housing 24, with prize designating member/system 26 comprising one selected from the group consisting of cash, vouchers, coupons, certificates, audible or visual message delivery circuits and remotely activated, prize designating electronic circuits.

In FIG. 11, prize award system 20 is depicted as comprising housing 24 having an elongated, generally hollow, cylindrical shape formed in combination with a diverging collar portion 28 and a removable cap or cover 54. In this embodiment, housing 24 incorporates cavity 29 for secretly retaining any desired prize award, as detailed above. By using this embodiment, housing 24, forming prize award system 20, is positioned in the manner detailed above in any suitable void zone 25 of a multi-pack product/assembly 21, for secretly retaining an actual prize, or prize related material, in direct association with the multi-pack product.

Figure 13:
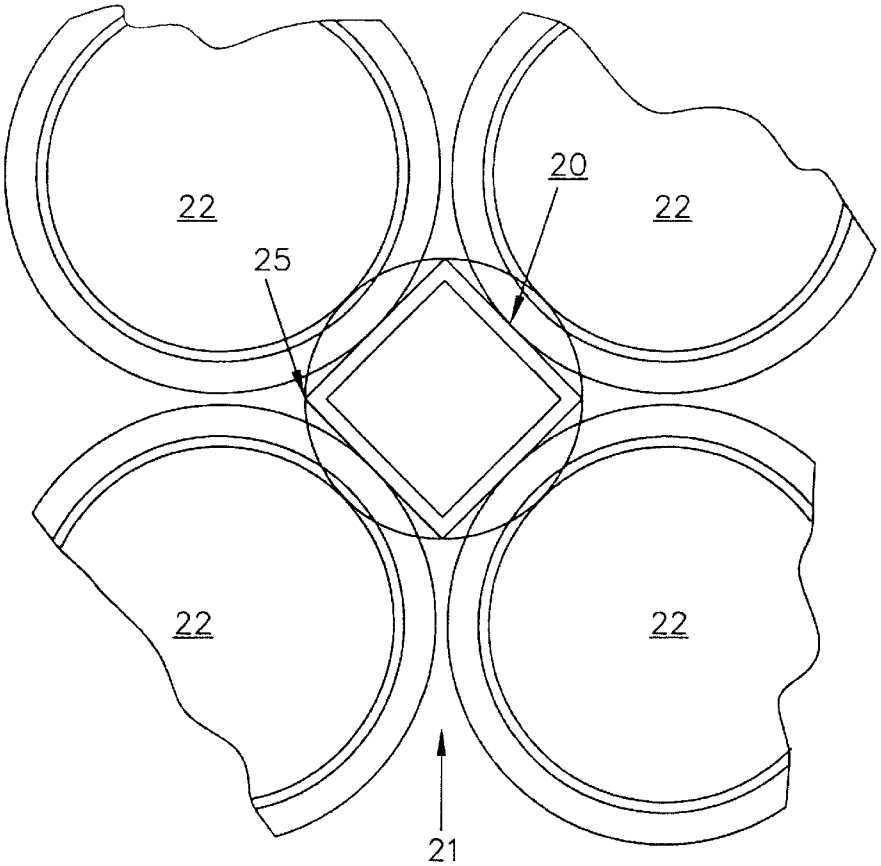
FIG. 13 is a top plan view of the prize award system of FIG. 12 mounted in direct association with a plurality of containers forming a multi-pack product/assembly.
Figure 12:
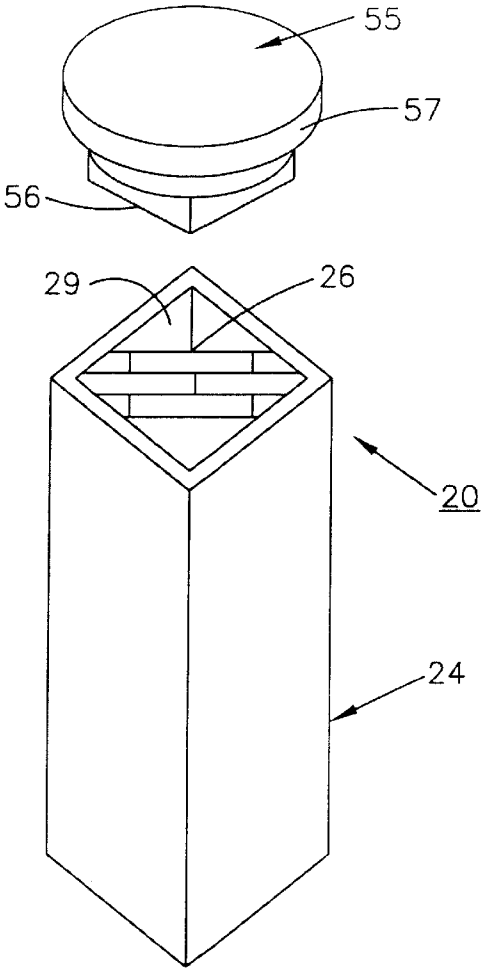
FIG. 12 is an exploded perspective view of a further alternate embodiment of the prize award system of the present invention.

In FIG. 12, a further alternate embodiment of the present invention is depicted. In this embodiment, prize award system 20 comprises a rectangular or square shaped housing 24 which is constructed for nested interengagement in the void zone 25 formed between adjacent containers 22, as depicted in FIG. 13. Although this embodiment employs a square shaped housing 24, it is apparent to one of ordinary skill in the art that housing 24 may comprise any desired size or shape depending upon the configuration of the void zone existing between the adjacent containers of multi-pack product/assembly 21.

Another feature of this embodiment of the present invention is the use of a removable cap 55 which is constructed for mounted interengagement in cavity 29 of housing 24. As a result, cap 55 incorporates a base 56 which is dimensioned for insertion into cavity 29 in secure interengagement therein. In addition, cap 55 also incorporates a diverging collar portion 57 which is constructed for cooperative association with the shoulders 35 of containers 22, in order to securely suspend prize award system 20 in the desired positioned in direct association with containers 22 of multi-pack product/assembly 21.

Although a removable cap 55, incorporating diverging collar portion 57, is depicted in association with square shaped housing 24, it is apparent that a similarly constructed cap is employable with any of the embodiments previously disclosed or any alternate shape employed for carrying out the teaching of the present invention.

Figure 14:
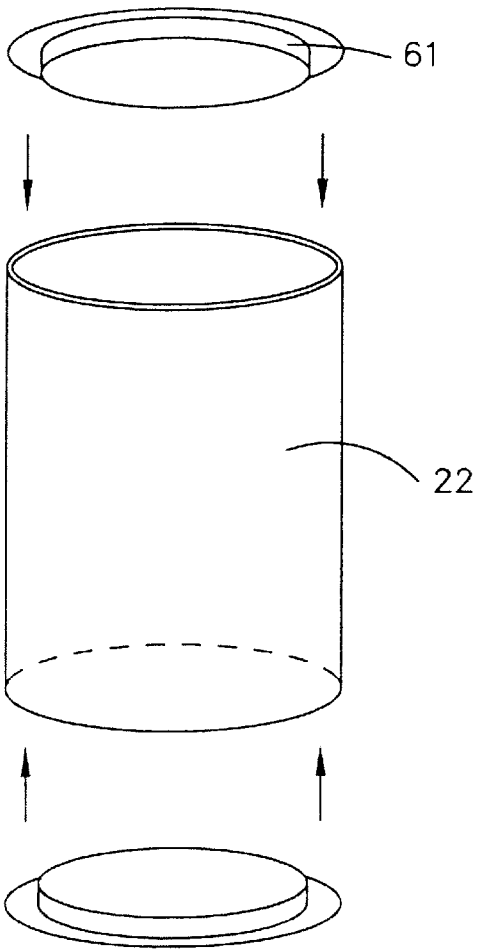
FIG. 14 is a perspective view of two additional embodiments of the prize award system of the present invention construction for mounted interengagement in the void zones formed in the top and bottom of a product holding container.

In FIG. 14, a further alternate embodiment of prize award system 20 of the present invention is depicted. In this embodiment, container 22 is in the form of a conventional soda or beverage can which incorporates void or open zones in the top and bottom surfaces thereof. In order to securely retain a prize award in direct association with can 22, prize award system 20 comprises housing 61 and/or housing 62, each of which are configured for nested interengagement in the void or open zone of the top and bottom ends of can 22.

In accordance with this embodiment of the present invention, housings 61 and 62 each incorporates an interior cavity within which the desired prize designating member/system 26 is secured. By mounting one or more housings 61 and/or 62 in direct association with one or more cans 22 of a multi-pack product/assembly, the desired prize award system 20 of the present invention is implemented with prize delivery means secretly retained in direct association with the container itself.

Figure 15:
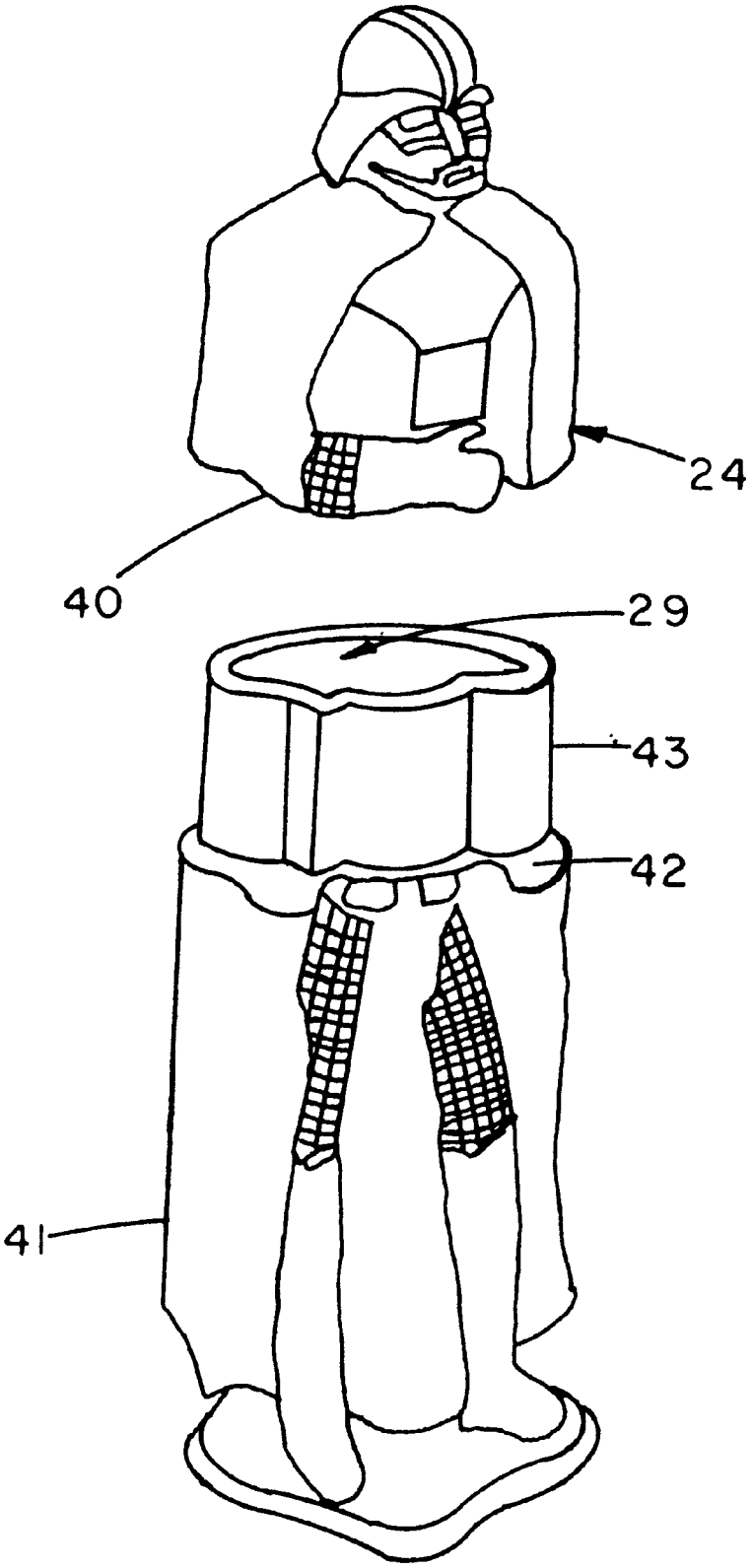
FIG. 15 is a perspective view of a further additional alternate embodiment of the prize award system of the present invention wherein said housing is in the form of a collectible product.
Figure 16:
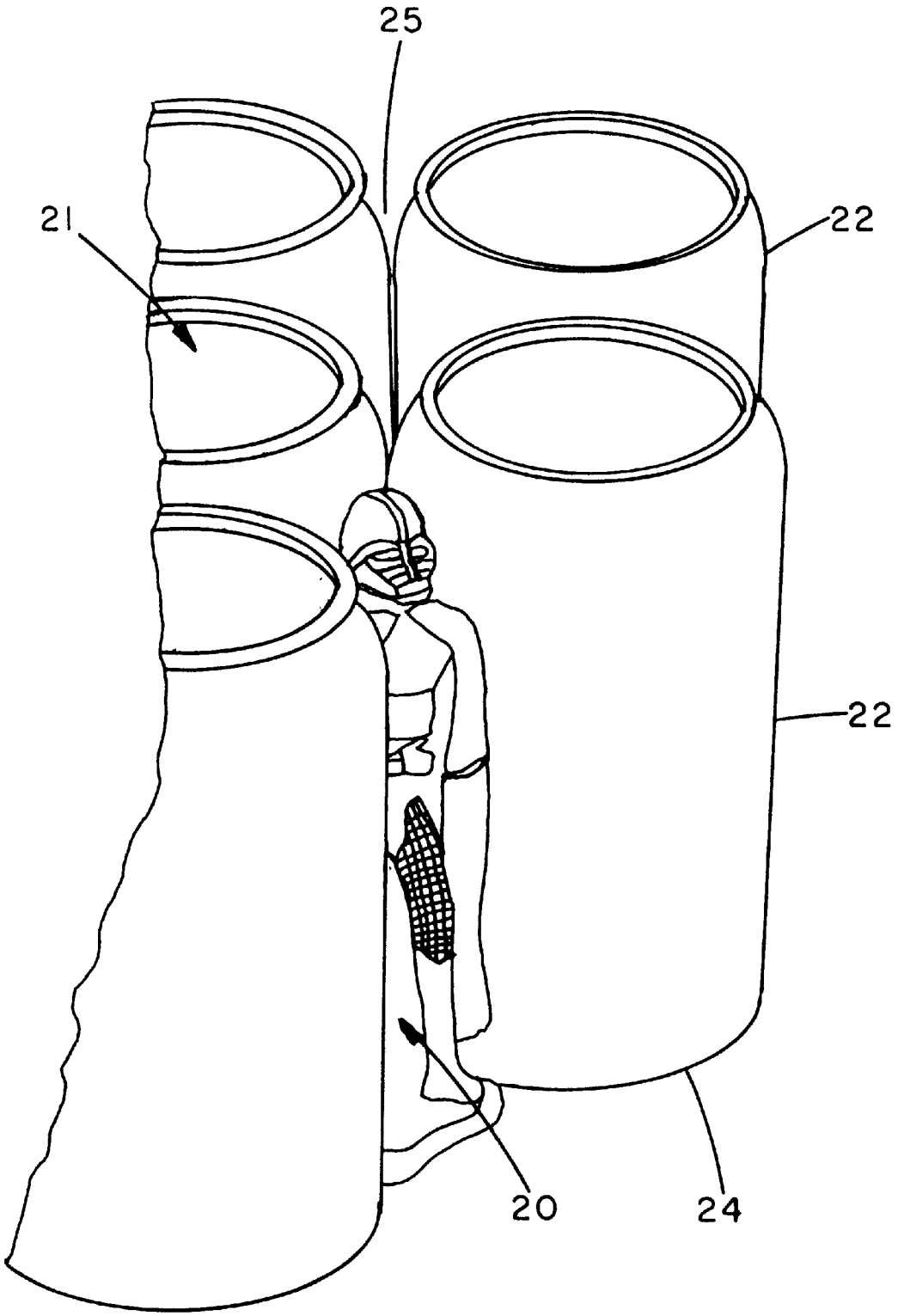
FIG. 16 is a perspective view depicting the prize award system of FIG. 15 mounted in association with a plurality of containers forming a multi-pack product/assembly.

In FIGS. 15 and 16, a final alternate embodiment of the present invention is depicted. In this embodiment, prize award system 20 comprises a housing 24 having a specific, unique shape and visual appearance. As depicted, for exemplary purposes only, housing 24 is constructed to visually appear as a character from a popular movie, however, any other desired character, image, design, shape, individual, action figure, animal, or desirable appearance can be employed with equal efficacy.

In the embodiment depicted in FIGS. 15 and 16, housing 24 comprises an upper portion 40 and a lower portion 41 which are constructed for mating, telescopic, locking interengagement with each other. In this regard, as detailed above, lower portion 41 incorporates ledge 42 and upstanding, inwardly positioned wall 40 which is constructed for mating, telescopic interengagement with upper portion 40. In addition, housing 24 incorporates a cavity 29 within which any desired prize designating member/system 26 is securely mounted.

Although this configuration for prize award system 20 is preferred, any alternate construction can be employed while still forming housing 24 as a particular character, image, logo, design, shape, individual, action figure, animal, and the like, without departing from the scope of this invention. In addition, as depicted in FIGS. 15 and 16, housing 24 preferably incorporates an outwardly extending or diverging collar portion 28 formed at the base of lower portion 41. As shown in FIGS. 15 and 16, collar portion 28 is constructed for mating interengagement with lower shoulder 36 formed as part of containers 22, in order to assure that housing 24 is securely retained in the precisely desired void zones/open space 25 formed between containers 22. In this way, assurance is provided that this embodiment of prize award system 20 is securely positioned in void zones/open space 25, remaining undiscoverable until the securement/wrapping means peripherally surrounding multi-pack product/assembly 21 is removed.

By employing this embodiment of prize award system 20, consumers are able to receive a unique prize award contained in cavity 29 of housing 24, while also receiving a unique, specially designed and constructed collectible housing 24. If desired, a plurality of alternate constructions for housing 24 can be employed in a single promotion for further enhancing consumer excitement and interest and increasing consumers'desire to purchase multi-packed product/assemblies 21 in order to seek to obtain the entire set of housing configurations forming a part of the promotional contest.

It will thus be seen that the objects set forth above, among those made apparent from the preceding description, are efficiently attained and, since certain changes may be made in the above constructions without departing from the scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said if all therebetween.

What is claimed is:

1. A prize delivery system cooperatively associated with a package which comprises an integrated assembly formed by a plurality of separate and independent product retaining containers, said containers being mounted in side-by-side, adjacent relationship with each other and each container having an inner surface defining a retention zone in which a product is stored in each of said containers and an outer surface which cooperates with the outer surfaces of adjacent product retaining containers to form an open zone therebetween, whereby a plurality of open zones are formed between the plurality of adjacent containers forming the package said prize delivery system comprising:

A. a discrete housing different in construction from said containers and comprising;

a. an outer surface dimensioned for insertion and retention in one of the plurality of open zones formed by the adjacent outer surfaces of the product retaining containers, and b. an interior cavity within which a prize designating member is retained; and B. a prize designating member constructed for being securely retained in the cavity of the housing in undiscoverable association therewith until removed from the package and opened, whereby a prize delivery system is attained for enabling the promotion and sale of the package by providing a prize award which is secretly retained in said package and is undiscoverable by the consumer prior to opening the package, thereby preventing advance detection of the prize award.

2. The prize delivery system defined in claim 1, wherein said housing is further defined as comprising an elongated, longitudinally extending shape, dimensioned for insertion and retention in an open zone formed between the adjacent containers.

3. The prize delivery system defined in claim 2, wherein said housing is further defined as comprising the visual appearance of one selected from the group consisting of characters, individuals, cartoon people, animals, objects, and designs, shapes, and logos, thereby establishing a housing which may be employed as a collectible.

4. The prize delivery system defined in claim 1, wherein said prize designating member is further defined as comprising one selected from the group consisting of cash, gifts, vouchers, certificates, coupons, message delivery circuits, and remotely activated electronic circuits.

5. The prize delivery system defined in claim 1, wherein said housing is further defined as comprising holding means for securely retaining the prize designating member in the cavity thereof.

6. The prize delivery system defined in claim 5, wherein said holding means comprises longitudinally extending slots for receiving and retaining the prize designating member therein.

7. A prize delivery system cooperatively associated with a package which comprises an integrated assembly formed by a plurality of separate and independent product retaining containers, said containers being mounted in side-by-side, adjacent relationship with each other and each having an inner surface defining a retaining zone in which a product is stored in each of said containers and an outer surface which cooperates with the outer surfaces of adjacent product retaining containers to form an open zone therebetween, whereby a plurality of open zones are formed between the plurality of adjacent containers forming the package, each of said product retaining containers forming the package comprising a shoulder zone formed on the outer surface thereof, said prize delivery system comprising:

A. a discrete housing different in construction from said containers and comprising A. an outer surface dimensioned for insertion and cooperating engagement in one of the plurality of open zones formed by the adjacent outer surfaces of the product retaining containers, B. an interior cavity within which a prize designating member is retained, and C. a support member formed on the outer surface of the housing and constructed for cooperative engagement with the shoulder zones of the adjacent product retaining containers forming the previously open zone of the package; and B. a prize designating member constructed for being securely retained in the cavity of the housing in undiscoverable association therewith until removed from the package and opened, whereby a prize delivery system is attained for enabling the promotion and sale of the package by providing a prize award which is secretly retained said package and is undiscoverable by the consumer prior to opening the package, thereby preventing advance detection of a prize award.

8. The prize delivery system defined in claim 7, wherein said support means is further defined as comprising an outwardly extending collar formed at one end of the housing, constructed for mating interengagement with the shoulder zones of the containers with which the housing is mounted.

9. The prize delivery system defined in claim 8, wherein said outwardly extending collar is further defined as being integrally formed with the housing.

10. The prize delivery system defined in claim 8, wherein said housing is further defined as comprising a removable cap cooperatively associated therewith for enabling access to the interior of the housing to be easily attained by removal of the cap.

11. The prize delivery system defined claim 10, wherein said removable cap further comprises an outwardly extending collar integrally formed therewith for supportingly retaining the cap and housing in association with the containers forming the package.

12. A prize delivery system cooperatively associated with a package which comprises an integrated assembly formed by a plurality of separate and independent product retaining containers, mounted in side-by-side, adjacent relationship with each other and having outer surfaces which cooperate to form an open zone therebetween, said prize delivery system comprising:

A. a housing comprising:

a. an outer surface dimensioned for insertion and retention in at least one open zone formed between the adjacent product retaining containers, and b. an interior cavity within which a prize designating member is retained, and c. two separate and independent members telescopically mountable to each other; and B. a prize designating member constructed for being securely retained in the cavity of the housing in undiscoverable association therewith until removed from the package and opened, whereby a prize delivery system is attained for enabling the promotion and sale of the package by providing a prize award which is secretly retained in at least said one package and is undiscoverable by a consumer prior to opening the package, thereby preventing advance detection of a prize award when the prize bearing package is randomly distributed with non-prize bearing packages.

13. The prize delivery system defined in claim 12, wherein one member of said housing is further defined as comprising a ledge peripherally surrounding the outer wall of the housing and an upstanding wall extending from said ledge and constructed for mating, telescopic, sliding interengagement with the second member of the housing.

14. The prize delivery system defined in claim 12, wherein one member of said housing comprises a base portion incorporating an elongated longitudinally extending channel formed therein and a second member comprises an elongated member constructed for telescopic sliding interengagement into the channel of a first member.

15. The prize delivery system defined in claim 14, wherein said second member incorporates a cavity within which a prize designating member is retained.

16. A prize delivery system comprising:

A. a package comprising:

a. an integrated assembly formed by a plurality of separate and independent product retaining containers, b. a plurality of containers mounted in side-by-side, adjacent relationship with each other for forming a plurality of open zones, each of said containers having 1. an inner surface defining a retaining zone in which a product is stored in each of said containers, and 2. an outer surface which cooperates with the outer surfaces of adjacent product retaining containers to form said open zones therebetween;

B. a discrete housing different in construction from the containers and comprising:

a. an outer surface dimensioned for insertion and retention in one of the plurality of open zones formed by the adjacent outer surfaces of the product retaining containers, and b. an interior cavity within which a prize designating member is retained; and C. a prize designating member constructed for being securely retained in the cavity of the housing in undiscoverable association therewith until removed from the package and opened, whereby a prize delivery system is attained for enabling the promotion and sale of the package by providing a prize award which is secretly retained in said package and is undiscoverable by the consumer prior to opening the package, thereby preventing advance detection of the prize award even when the package is randomly distributed with non-prize bearing packages.

* * * * *